US005632542A

United States Patent [19]

Krivec

[11] Patent Number: 5,632,542

[45] Date of Patent: May 27, 1997

[54] DRAWER SLIDE INTERLOCK APPARATUS

[75] Inventor: Bert Krivec, Waukesha, Wis.

[73] Assignee: Snap-on Technologies, Inc., Crystal Lake, Ill.

[21] Appl. No.: 474,733

[22] Filed: Jun. 7, 1995

[51] Int. Cl.[6] ..... A47B 89/00

[52] U.S. Cl. ..... 312/334.7; 403/393; 403/294; 403/386; 312/348.1

[58] Field of Search ..... 312/330.1, 334.7, 312/348.1; 108/110; 403/393, 294, 386

[56] References Cited

U.S. PATENT DOCUMENTS

| | | | |
|---|---|---|---|
| 2,675,277 | 4/1954 | McClellan . | |
| 2,686,704 | 8/1954 | Wolters . | |
| 2,911,276 | 11/1959 | Hiers . | |
| 3,110,536 | 11/1963 | Costantini et al. . | |
| 3,377,115 | 4/1968 | Hansen et al. | 312/330.1 |
| 3,744,869 | 7/1973 | Anderson et al. . | |
| 3,771,849 | 11/1973 | Barber | 312/350 |
| 3,921,365 | 11/1975 | Nute, Jr. et al. . | |
| 4,025,138 | 5/1977 | Kittle . | |
| 4,031,594 | 6/1977 | Cepuritis . | |
| 4,338,990 | 7/1982 | Blodee et al. . | |
| 4,537,450 | 8/1985 | Baxter . | |
| 4,566,743 | 1/1986 | Henriott . | |
| 4,575,164 | 3/1986 | Pinnow et al. . | |
| 4,632,473 | 12/1986 | Smith . | |
| 4,838,627 | 6/1989 | Macias . | |
| 4,925,258 | 5/1990 | Ludwig et al. . | |
| 4,998,828 | 3/1991 | Hobbs . | |
| 5,050,942 | 9/1991 | Frederick et al. . | |
| 5,137,390 | 8/1992 | Felsen . | |
| 5,209,572 | 5/1993 | Jordan . | |

*Primary Examiner*—Peter M. Cuomo
*Assistant Examiner*—Gerald A. Anderson
*Attorney, Agent, or Firm*—Emrich & Dithmar

[57] ABSTRACT

An interlock apparatus for connecting a drawer slide member having a planar connecting surface to a slide receiving member having first and second substantially parallel surfaces is provided. The interlock apparatus includes a plurality of male interlock members integral with the drawer slide member, each interlock member defining a loop extending out of the plane of the connecting surface and having a first bearing surface thereon. The apparatus also includes a plurality of apertures disposed in the slide receiving member, each aperture defining a single uninterrupted second bearing surface. Each interlock member extends through an aperture to a mounted condition with the first and second bearing surfaces in contact with each other to connect the drawer slide and the slide receiving member together. The loops are retained in the mounted condition by pins therethrough or by retaining surfaces thereon.

20 Claims, 3 Drawing Sheets

DRAWER SLIDE INTERLOCK APPARATUS

BACKGROUND OF THE INVENTION

1. Field of the Invention

This invention relates generally to drawer slides and, more specifically, to assemblies to connect the slides to drawers and cabinets or other furniture.

2. Description of the Prior Art

Drawer slide assemblies for slidably supporting a drawer to allow a drawer to slide into and out of a cabinet, chest or other piece of furniture between closed and open conditions, frequently have a three-piece construction. Such an assembly includes a drawer-side slide member connected to a drawer, a cabinet-side slide member connected to the frame of a cabinet and an intermediate piece slidably coupled to the drawer and cabinet members, as by ball bearing assemblies. The drawer-side and cabinet-side slide members usually are respectively connected to the drawer and cabinet frame by a hook or clip connected only at one end to the planar back surface of each slide member. Each hook extends out of the plane of the planar back surface. The drawer and the cabinet frame each have corresponding apertures engageable with the hooks. Each hook is disposed through an aperture so that a portion of the side wall of the drawer or a piece of the frame is disposed between the hook and the back surface of the slide member to create an interlocking fit to connect the respective slide member to either the cabinet or drawer.

This type of interconnection however is not always satisfactory. The hook on the slide is vulnerable to bending or tearing and it can be easily damaged if a heavy load is stored in the drawers.

SUMMARY OF THE INVENTION

It is a general object of the invention to provide an improved drawer slide interlock apparatus which avoids the disadvantages of the prior assemblies while affording structural and operational advantages.

An important feature of the invention is the provision of an interlock apparatus which is of relatively simple and economical construction.

Another feature of the invention is the provision of an interlock apparatus of the type set forth which will not easily deform or break in use.

Yet another feature is the provision of an interlock apparatus of the type set forth which is capable of supporting a drawer which carries a heavy load.

These and other features of the invention are attained by providing an interlock apparatus for connecting a drawer slide member which has a planar connecting surface to a slide receiving member having first and second substantially parallel surfaces. The interlock apparatus includes a plurality of male interlock members integral with the drawer slide member, each interlock member defining a loop extending out of the plane of the connecting surface and having a first bearing surface thereon. The apparatus further includes a plurality of apertures disposed in the slide receiving member, each aperture defining a single uninterrupted second bearing surface. Each interlock member extends through an aperture to a mounting condition with the first and second bearing surfaces in contact with each other to connect the drawer slide to the slide receiving member.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
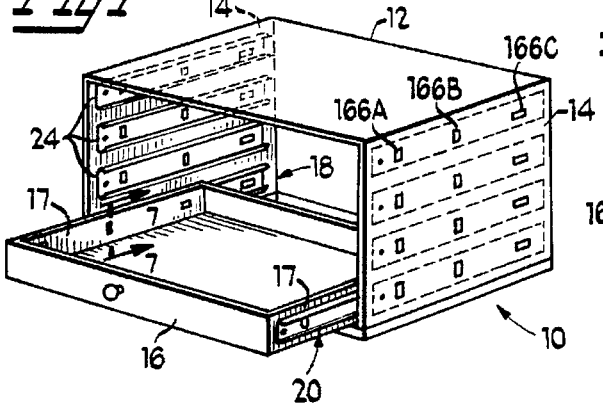
FIG. 1 is a perspective view illustrating a drawer slide assembly connected to a cabinet and to an open drawer by the interlock apparatus of the present invention.
Figure 2:
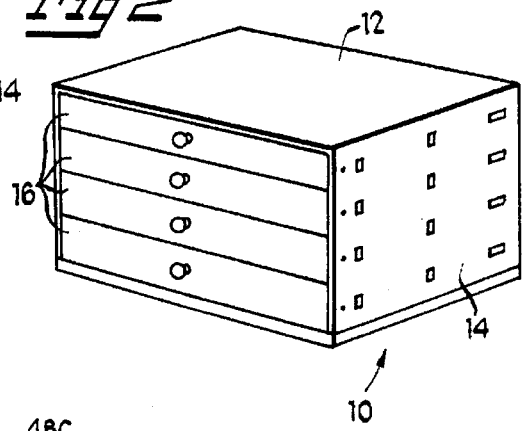
FIG. 2 is a perspective view of the cabinet of FIG. 1 with all its drawers in place and closed.

Referring to FIGS. 1 and 2, a cabinet assembly 10 includes an outer shell 12 having a pair of generally parallel side walls 14. A plurality of drawers 16, each having a pair of generally parallel side walls 17, are each slidably supported on a pair of drawer slide assemblies 18 and 20. Since drawer slide assemblies 18 and 20 are mirror images of each other, only drawer slide assembly 18 will he discussed in detail.

Figure 7:
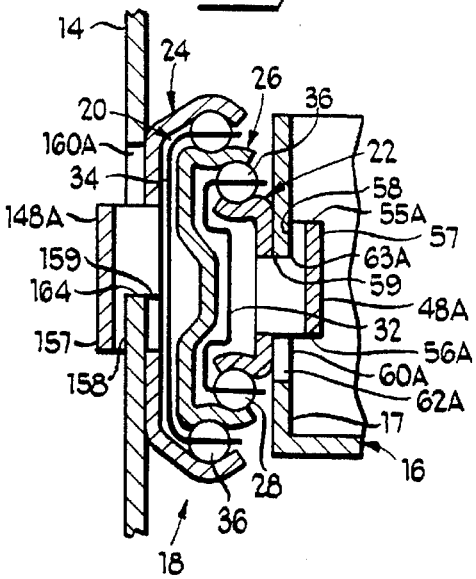
FIG. 7 is an enlarged, fragmentary, sectional view taken generally along the line 7—7 of FIG. 1.

Referring to FIG. 7, drawer slide assembly 18 includes a drawer-side member 22, a cabinet-side member 24 and an intermediate member 26. Drawer slide assembly 18 further includes a ball bearing assembly 28 disposed between the drawer-side member 22 and the intermediate member 26 and a ball bearing assembly 30 disposed between the intermediate member 26 and the cabinet-side member 24. Ball bearing assemblies 28, 30 are of conventional construction and include respective ball positioning brackets 32, 34 for positioning a plurality of balls 36 which are supported by races.

As discussed in greater detail below, the drawer side member 22 is connected to the side wall 17 of the drawer 16 and the cabinet-side member 24 is attached to the cabinet side wall 14. In operation, the intermediate member 26 is reciprocatively slidable relative to each of the cabinet-side member 24 and the drawer-side member 22, aided by the rotation of the balls 36, for facilitating movement of the drawer 16 between its open and closed positions, all in a known manner.

The drawer-side member 22 and the cabinet-side member 24 are attached, respectively, to the side wall 17 of the drawer 16 and one side wall 14 of the outer shell 12 by substantially identical means. The means for attaching the drawer-side member 22 will be discussed in detail and is applicable to the means for attaching the cabinet-side member 24. Any differences will be noted below.

Figure 3:
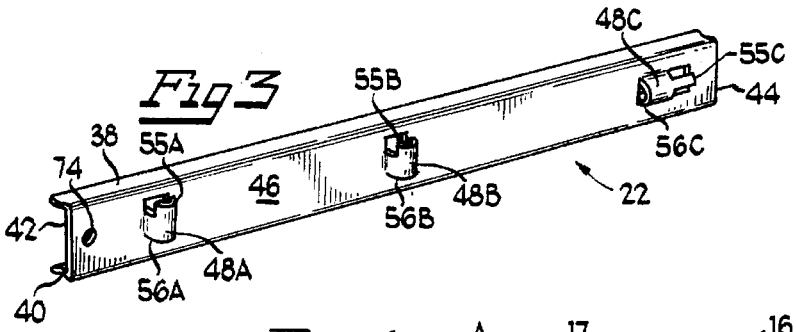
FIG. 3 is a perspective view of a drawer-side slide member having interlock members of the present invention.

As seen best in FIG. 3, each drawer-side member 22 is an elongated, flat, rectangular plate that includes a top flange 38, a bottom flange 40, a first end 42, a second end 44, and a substantially planar connecting surface 46. The planar connecting surface 46 has a height, as measured between the top and bottom flanges 38, 40 and a length as measured between the first and second ends 42, 44.

Figure 5:
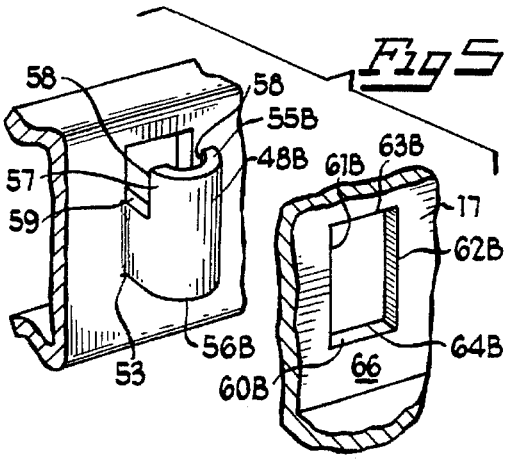
FIG. 5 is an enlarged, fragmentary, exploded, perspective view in partial section of the drawer-side slide member of FIG. 3 illustrating one of the interlock members and a mateable aperture of the drawer of FIG. 4.
Figure 6:
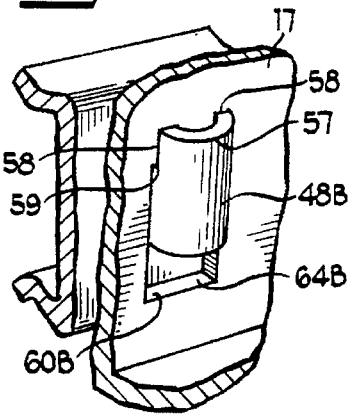
FIG. 6 is fragmentary perspective view in partial section of the parts of FIG. 5 shown in their engaged condition.
Figure 8:
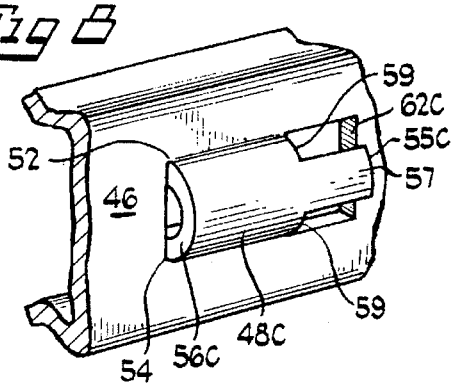
FIG. 8 is an enlarged, fragmentary, perspective view in partial section of the drawer-side slide member of FIG. 4 illustrating the rearmost one of the interlock members thereon.

The drawer-side member 22 also includes three male interlock members 48A, 48B, 48C. Male interlock members 48A and 48B are identical and have an axis that is parallel with the height of the drawer-side member 22. Male interlock member 48C has an axis perpendicular to the height of the drawer-side member 22. Referring also to FIGS. 5 and 8, each male interlock member 48A–C is a one-piece, part-cylindrical loop that extends out of the plane of planar connecting surface 46 and has a first end 52 and a second end 54 integral with the planar connecting surface 46. Each male interlock member may be formed or "struck" from the drawer-side member 22 to form a rectangular aperture therein.

The male interlock members 48A–C also respectively include first and second end surfaces 55A–C, 56A–C, substantially parallel to each other. Each interlock member is cut away at its end 55 adjacent to the connecting surface 46 to define a retaining portion 57. Each portion 57 has a pair of retaining surfaces 58 that are spaced from the planar connecting surface 46 substantially parallel thereto. Each male interlock member 48A–C also includes two surfaces 59, respectively extending between the retaining surfaces 58 and the planar connecting surface 46 and each substantially perpendicular to the axis of the associated male interlock member.

As best seen in FIGS. 4–7 and 10, each drawer side wall 17 has three rectangular apertures 60A–C that respectively receive the three male interlock members 48A–C. Apertures 60A, 60B, respectively, have first vertical surfaces 61A, 61B, second vertical surfaces 62A, 62B, first horizontal surfaces 63A, 63B and second horizontal surfaces 64A, 64B. Aperture 60C has first and second vertical surfaces 61C, 62C and first and second horizontal surfaces 63C, 64C. Each of the apertures 60A–C has a length and width respectively slightly greater than the overall length and width of the male interlock members 48A–C.

Figure 4:
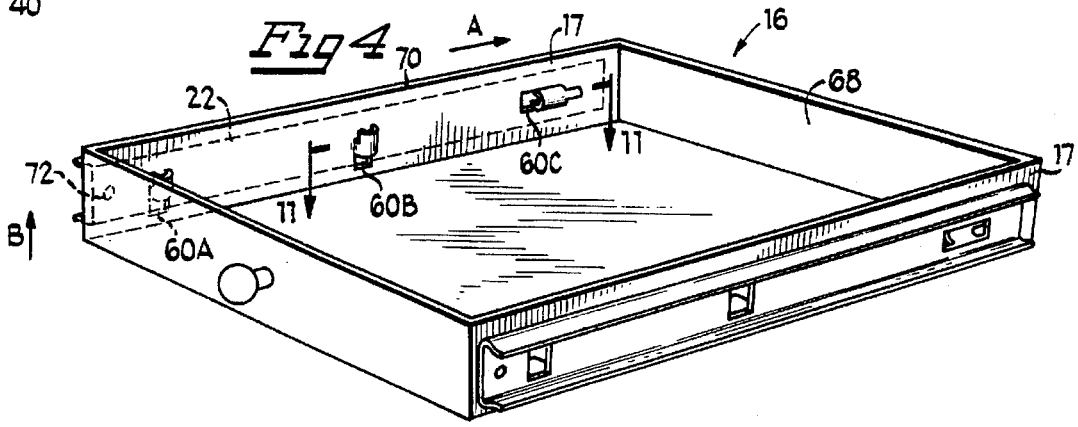
FIG. 4 is an enlarged perspective of the drawer of FIG. 1 having two drawer slide members connected to it via the interlock assembly of the present invention.
Figure 9:
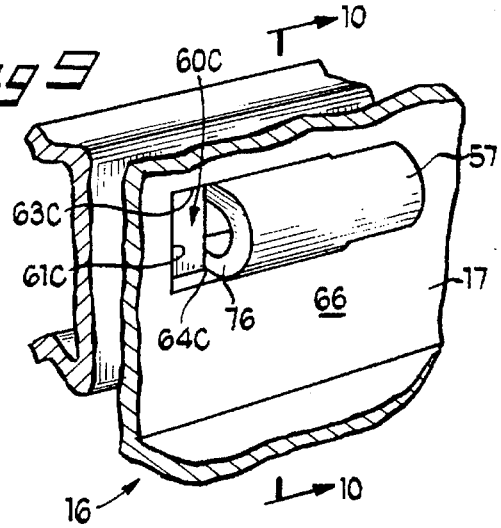
FIG. 9 is a fragmentary, perspective view in partial section illustrating the horizontal interlock member of FIG. 8 engaged with a corresponding aperture in the side wall of the drawer of FIG. 4.

Drawer-side member 22 is connected to side wall 17 as follows. Male interlock member 48C is inserted through aperture 60C so that at least the retaining portion 57 extends inwardly beyond a planar inner surface 66 of the side wall 17 (FIG. 9). As seen in FIG. 4, the drawer-side member 22 is then moved in the direction of arrow A until at least one of the surfaces 59 contacts the vertical aperture surface 62C closest to a back wall 68 of the drawer 16. Male interlock members 48A and 48B are then respectively inserted through apertures 60A, 60B so that retaining portions 57 extend inwardly beyond the inner surface 66 of the drawer side wall 17. The drawer-side member 22 is then moved upwards in the direction of arrow B until the surfaces 59 of male interlock members 48A, 48B contact the respective horizontal surfaces 63A, 63B closest to a top edge 70 of the side wall 17. In use, when the drawer-side member 22 is mounted, as seen in FIG. 7, the weight of the drawer 16 will maintain this contact between the horizontal surfaces 64A, 64B and the cut-out surfaces 59 of the male interlock members 48A, 48B which contacting surfaces serve as bearing surfaces. As seen in FIG. 4, a screw 72 can be inserted through a hole (see FIG. 3) in the drawer-side member 22 and into the side wall 17 to further connect the drawer-side member 22 to the side wall 17 and maintain the drawer-side member 22 in proper position and to prevent disengagement.

As seen in FIGS. 6, 7, 9 and 11, the retaining portions 57 of male interlock members 48A, 48B extend above the first horizontal surfaces 63A, 63B of the apertures 60A, 60B. Additionally, retaining portion 57 of male interlock member 48C extends rearwardly beyond the second vertical surface 62C of aperture 60C. This enables the retaining surfaces 58 of the portions 57 of male interlock members 48A–C to contact the inner surface 66 of drawer side wall 17 to prevent the male interlock members 48A–C and the drawer-side member 22 from moving in a direction perpendicular to the inner surface 66 after the drawer-side member 22 has been attached to the side wall 17.

Figure 10:
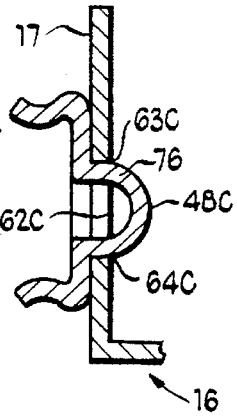
FIG. 10 is a sectional view taken generally along the line 10—10 of FIG. 9.
Figure 11:
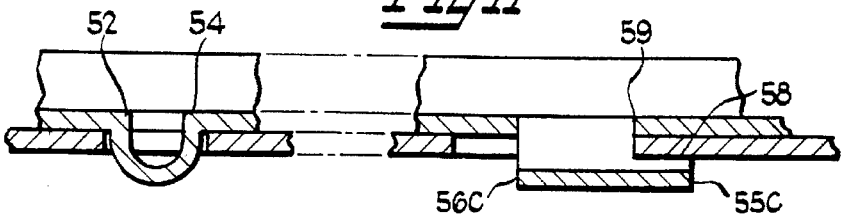
FIG. 11 is a fragmentary sectional view taken generally along the line 11—11 of FIG. 4.

In use, as best seen in FIGS. 4–7, the first horizontal surfaces 63A, 63B of apertures 60A, 60B bear on the cut-out surfaces 59 of male interlock members 48A, 48B, respectively. Also, as best seen in FIGS. 9–10, male interlock member 48C has a surface portion 76 substantially parallel to the axis of the male interlock member 48C upon which the first horizontal surface 63C of aperture 60C bears. Since male interlock members 48A–C are loop-shaped and are each integral at two ends 52, 54 with the drawer-side member 22, they are each able to withstand large downward forces. It has been found that an engaged male interlock member, similar to member 48A, has been able to withstand almost twice the force of conventional non-looped interlock members made of similar material.

As seen in FIGS. 1, 7 and 12–14, the cabinet-side member 24 includes three male interlock members 148A, 148B, 148C and is attached to a side wall 14 of the outer shell 12 in a manner nearly identical to the manner in which the drawer-side member 22 is attached to the side wall 17 of the drawer 16. The attachment, however, is slightly different because the cabinet-side member 24 is supported by the side wall 14 of the outer shell 12, rather than supporting it.

Figure 12:
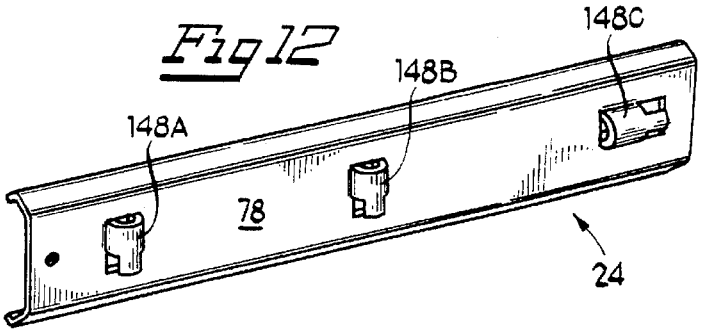
FIG. 12 is a perspective view of one of the cabinet-side slide members of FIG. 1.

As best seen in FIG. 12, the three male interlock members 148A–148C of cabinet-side member 24 are substantially identical to the male interlock members 48A–C of the drawer-side member 22 and are engageable with apertures 160A–C disposed in the side walls 14 of the outer shell 12 which are respectively dimensionally identical to apertures 60A–60C. Each male interlock member 148A–C includes a retaining portion 157, a pair of retaining surfaces 158 and a pair of surfaces 159 each disposed between a respective retaining surface and a planar connecting surface 78 of the cabinet-side member 24.

Figure 13:
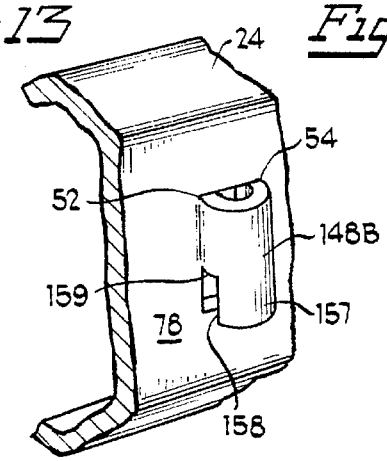
FIG. 13 is a fragmentary, perspective view in partial section of the cabinet-side slide member of FIG. 12 illustrating one of the interlock members thereon.
Figure 14:
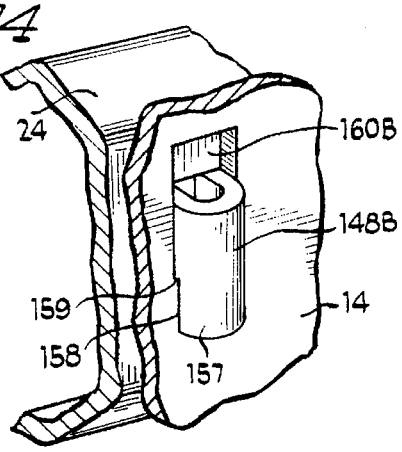
FIG. 14 is a fragmentary, perspective view in partial section of the interlock member of FIG. 13 engaged with an aperture of the cabinet.
Figure 15:
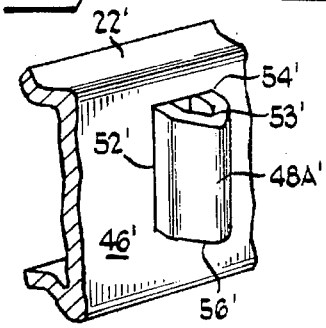
FIG. 15 is a fragmentary, perspective view in partial section of a drawer-side slide member having an alternative interlock member.
Figure 16:
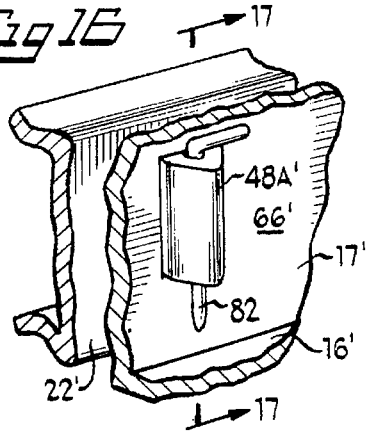
FIG. 16 is a fragmentary, perspective view in partial section of illustrating the alternative interlock member of FIG. 15 engaged with an aperture of a drawer.

As best seen in FIGS. 7, 13 and 14, male interlock members 148A and 148B are engageable with apertures 160A and 160B, which are dimensionally identical to apertures 60A and 60B. As best seen in FIG. 7, the retaining portions 157 of male interlock members 148A, 148B face in a downward direction and the surfaces 159 of male interlock members 148A, 148B respectively bear on a horizontal surface 164 of the apertures 160A, 160B so that the side wall 14 supports the cabinet-side member 24 which, in turn, through the intermediate member 26 and races 28 and 30, supports the drawer-side member, which supports the drawer 16.

Male interlock member 148C is engageable with an aperture in the same manner as was described above for the male interlock member 48C and aperture 60C, and will not be further discussed.

FIGS. 15–18 show an alternative male interlock member 48A' which could replace male interlock members 48A, 48B and 148A, 148B, while FIGS. 19–22 show an alternative male interlock member 48C', which could replace male interlock members 48C, 148C. Both of these alternative interlock members are shown disposed on a drawer-side member 22' having a planar connecting surface 46'. Male interlock members 48A', 48C' are each a one-piece loop having a first end 52' and a second end 54' integral with the drawer-side member 22' and further having a first end surface 55' and a second end surface 56' substantially parallel to each other. Unlike male interlock members 48A–C and 148A–C, male interlock members 48A' and 48C' are not cut away and, therefore do not have a retaining portion. Rather, each has a uniform transverse cross-section between their respective first and second end surfaces 55', 56'. Male interlock members 48A', 48C' also have an inner surface 80 which faces the planar connecting surface 46'. Male interlock member 48A' and 48C' are engageable with apertures 60A' and 60C' of a side wall 17' of a drawer 16', which are identical to apertures 60A, 60C described above. To mount the drawer-side member 22' onto the side wall 17', male interlock members 48A', 48C' are respectively inserted through apertures 60A', 60C' so that a portion of each male interlock member 48A, 48C extends beyond the plane of an inner planar surface 66' of the side wall 17'. An L-shaped pin 82 having a length greater than the length of each male interlock member 48A', 48C' is inserted between the inner surface 80 of each male interlock member 48A', 48C' and the planar inner surface 66' of the side wall 17'. After insertion, the pins 82 are in contact with the planar inner surface 66' and aid in preventing the male interlock members 48A', 48C' and drawer-side member 22' from moving in a direction perpendicular to the planar inner surface 66'.

Figure 17:
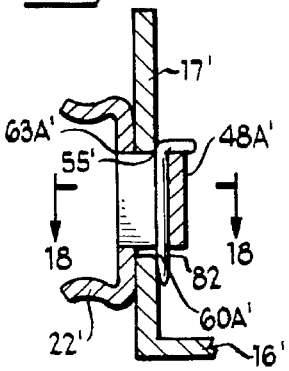
FIG. 17 is a sectional view taken generally along line 17—17 of FIG. 16.
Figure 18:
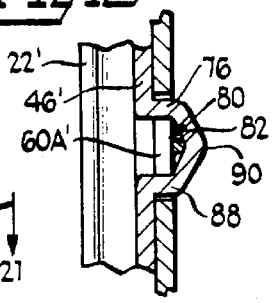
FIG. 18 is a fragmentary sectional view taken generally along line 18—18 of FIG. 17.
Figure 19:
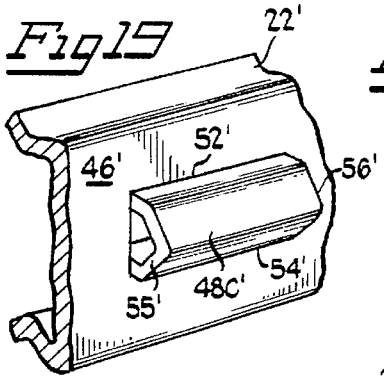
FIG. 19 is a view similar to FIG. 15 showing an alternative interlock member disposed horizontally on a drawer-side slide member.
Figure 20:
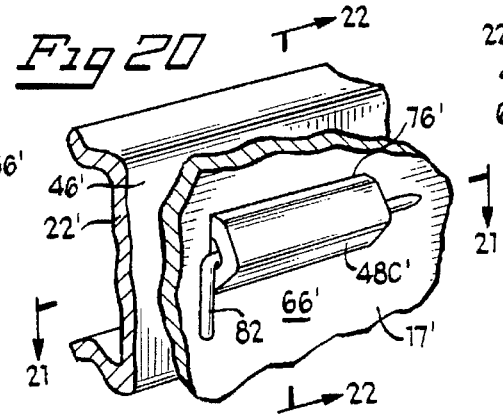
FIG. 20 is a view similar to FIG. 16 illustrating the interlock member of FIG. 19 engaged with an aperture of a drawer.
Figure 21:
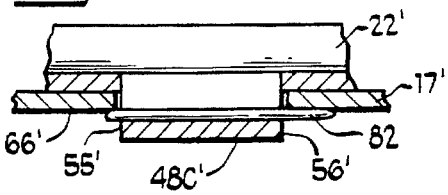
FIG. 21 is a sectional view taken generally along the line 21—21 of FIG. 20.
Figure 22:
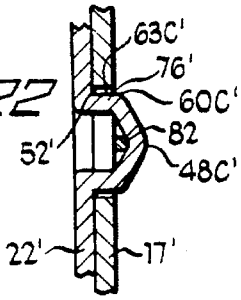
FIG. 22 is a fragmentary sectional view taken generally along the line 22—22 of FIG. 20.

Drawer 16' is supported on drawer-side member 22' similarly to the manner in which drawer 16 was supported on drawer-side member 22. As seen in FIG. 17, the aperture 60A' includes a first horizontal surface 63' which bears on the first end surface 55' of male interlock member 48A'. Additionally, as seen in FIGS. 20 and 22, aperture 60C' includes a first horizontal surface 63C' which bears on a surface portion 76' of male interlock member 48C', which is adjacent the first end 52' and which extends between the first and second end surfaces 55', 56'. Surface portion 76' of male interlock member 48C' and the first end surface 55' of male interlock member 48' cooperate to support drawer 16'.

Male interlock members 48A', 48C' have a slightly different shape from the male interlock members 48A–C, 148A–C of FIGS. 1–14. As seen best in FIGS. 15–22, male interlock members 48A', 48C' each have first and second substantially parallel portions 86, 88 adjacent to the first and second ends 52', 54', respectively, which are substantially perpendicular to the planar connecting surface 46'. Male interlock members 48A', 48C' also include a generally V-shaped portion 90 which connects the first and second parallel portions 86, 88 to form a loop. Though only two shapes have been illustrated, the male interlock members 48, 148 and 48' of the present invention can have a wide variety of shapes including box-like and triangular-like shapes and other shapes which can provide the appropriate bearing surfaces.

In the case of a male interlock member having an axis perpendicular to the height of the drawer-side member 22', like male interlock member 48C', this shape provides a greater surface area for the horizontal surface 63C' of aperture 60C' to bear against to provide a stronger interconnection.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. Connecting apparatus for connecting a drawer slide member having a planar connecting surface defining a plane to a slide receiving member having first and second substantially parallel surfaces, the apparatus comprising:

a plurality of male interlock members integral with the drawer slide member, each interlock member defining a fixed loop extending out of the plane defined by the planar connecting surface, the fixed loop having a first bearing surface and having first and second sides each connected to the planar connecting surface; and a plurality of single uninterrupted second bearing surfaces disposed on the slide receiving member, each second bearing surface defining a portion of an aperture, each interlock member extending through an aperture to a mounted condition with the first and second bearing surfaces in contact with each other to connect the drawer slide member to the slide receiving member.

2. The apparatus of claim 1, further including a plurality of pins respectively receivable through the fixed loops and engageable with the second surface in the mounted condition to prevent the drawer slide member from moving from said mounted condition.

3. The apparatus of claim 1, wherein in the mounted condition the planar connecting surface of the drawer slide member is disposed in facing relationship with the first surface of the slide receiving member and each fixed loop extends beyond the second surface of the slide receiving member, each fixed loop including a retaining surface engageable with the second surface of the slide receiving member to prevent movement of the loops from the mounted condition in a direction perpendicular to the second surface.

4. The apparatus of claim 1, wherein each fixed loop has a generally part-cylindrical shape.

5. The apparatus of claim 4, wherein the drawer slide member has a length and a height and at least one fixed loop has an axis substantially parallel with the height of the drawer slide member and wherein the first bearing surface is substantially perpendicular to the axis.

6. The apparatus of claim 4, wherein the drawer slide member has a length and a height and at least one fixed loop has an axis parallel to the length of the drawer slide member and wherein the first bearing surface is substantially parallel to the axis.

7. The apparatus of claim 5, wherein at least one fixed loop has an axis parallel to the length of the drawer slide member and wherein the first bearing surface is substantially parallel to the axis and in contact with the second bearing surface of an aperture.

8. The apparatus of claim 1, and further comprising means for fixedly securing the drawer slide member to the slide receiving member.

9. The apparatus of claim 8, wherein the securing means includes a screw disposed through a hole in the drawer slide member and onto the slide receiving member.

10. The apparatus of claim 1, wherein each fixed loop has a V-shaped portion.

11. Connecting apparatus for connecting a drawer slide assembly to a slide supporting member having first and second generally parallel surfaces and to a drawer side wall having third and fourth generally parallel surfaces, wherein the drawer slide assembly includes a first drawer slide member having a first planar connecting surface defining a first plane, and a second drawer slide member slidably coupled to the first drawer slide member and having a second planar connecting surface defining a second plane, the apparatus comprising:

a plurality of first male interlock members integral with the first drawer slide member, each first interlock member defining a first loop extending out of the first plane defined by the first planar connecting surface, the first loop having a first bearing surface;

a plurality of single uninterrupted second bearing surfaces disposed on the slide receiving member, each second bearing surface defining a portion of a first aperture, each first interlock member extending through a first aperture to a mounted condition with the first and second bearing surfaces in contact with each other to connect the first drawer slide member to the slide supporting member;

a plurality of second male interlock members integral with the second drawer slide member, each second interlock member defining a second loop extending out of the second plane defined by the second planar connecting surface, the second loop having a third bearing surface; and a plurality of single uninterrupted fourth bearing surfaces disposed on the slide receiving member, each fourth bearing surface defining a portion of a second aperture, each second interlock member extending through a second aperture with the third and fourth bearing surfaces in contact with each other to connect the second drawer slide member to the drawer side wall.

12. The apparatus of claim 11 further including a plurality of pins, respectively receivable through the first and second loops and engageable with the second and fourth bearing surfaces in the mounted conditions, respectively, to prevent the first and second drawer slide members from moving from the mounted conditions.

13. The apparatus of claim 12, wherein in the mounted condition the first planar connecting surface of the first drawer slide member is disposed in facing relationship with the first surface of the slide supporting member and each first loop extends beyond the second surface of the slide supporting member, each first loop including a first retaining surface engageable with the second surface of the slide supporting member to prevent movement of the first loops from the mounted condition in a direction perpendicular to the second surface, and wherein the second planar connecting surface of the second drawer slide member is disposed in facing relationship with the third surface of the drawer side wall and each second loop extends beyond the fourth surface of the drawer side wall, each second loop including a second retaining surface engageable with the fourth surface of the drawer side wall to prevent movement of the second loops from the mounted condition in a direction perpendicular to the fourth surface.

14. The apparatus of claim 11, wherein each first and second loop has a part-cylindrical shape.

15. The apparatus of claim 14, wherein the first drawer slide member has a length and a height and at least one first loop has a first vertical axis substantially parallel with the height of the first drawer slide member and wherein the first bearing surface is substantially perpendicular to the first vertical axis.

16. The apparatus of claim 15, wherein at least one first loop has a first horizontal axis substantially perpendicular to the height of the first drawer slide member and wherein the first bearing surface is substantially parallel to the first horizontal axis.

17. The apparatus of claim 14, wherein the second drawer slide member has a length and a height and at least one second loop has a second vertical axis parallel with the height of the second drawer slide member and wherein the third bearing surface is substantially perpendicular to the second vertical axis.

18. The apparatus of claim 17, wherein at least one second loop has a second horizontal axis substantially perpendicular to the height of the second drawer slide member and wherein the third bearing surface is substantially parallel with the second horizontal axis.

19. The apparatus of claim 11, and further comprising first means for fixedly securing the first drawer slide member to the slide supporting member and second means for fixedly securing the second drawer slide member to the drawer side wall.

20. The apparatus of claim 11, wherein the first and second loops respectively include first and second generally V-shaped portions each of which is connected to a pair of parallel portions.

* * * * *